United States Patent [19]

Kawamura

[11] 4,438,297

[45] Mar. 20, 1984

[54] DYNAMIC SPEAKER

[75] Inventor: Sinichiro Kawamura, Yokohama, Japan

[73] Assignee: Hitachi, Ltd., Tokyo, Japan

[21] Appl. No.: 324,445

[22] Filed: Nov. 24, 1981

[30] Foreign Application Priority Data

Nov. 28, 1980 [JP] Japan ..... 55-166538

[51] Int. Cl.[3] ..... H04R 9/02

[52] U.S. Cl. ..... 179/117; 179/115.5 DV; 179/119 R; 179/115 R; 179/181 R

[58] Field of Search ..... 179/115.5 DV, 114 R, 179/115 R, 117, 119 R, 181 R, 1 GP; 181/166

[56] References Cited

U.S. PATENT DOCUMENTS

| | | | |
|---|---|---|---|
| 2,897,291 | 7/1959 | Burke | 179/115.5 DV |
| 3,665,124 | 5/1972 | Sotome | 179/115.5 DV |
| 3,679,833 | 7/1972 | Inoue | 179/1 GP |
| 4,252,211 | 2/1981 | Matsuda et al. | 181/166 |
| 4,357,498 | 11/1982 | Tsuchiya et al. | 179/155.5 DV |

*Primary Examiner*—G. Z. Rubinson
*Assistant Examiner*—Robert Lev
*Attorney, Agent, or Firm*—Antonelli, Terry & Wands

[57] ABSTRACT

A plurality of nodes of split vibration of a diaphragm are driven by a plurality of voice coils to prevent split vibration of the diaphragm. The voice coils are inserted between three or more layers of magnetic poles respectively and driven by a magnetic circuit including a plurality of magnets magnetized in the same direction as the vibration of the voice coils.

4 Claims, 1 Drawing Figure

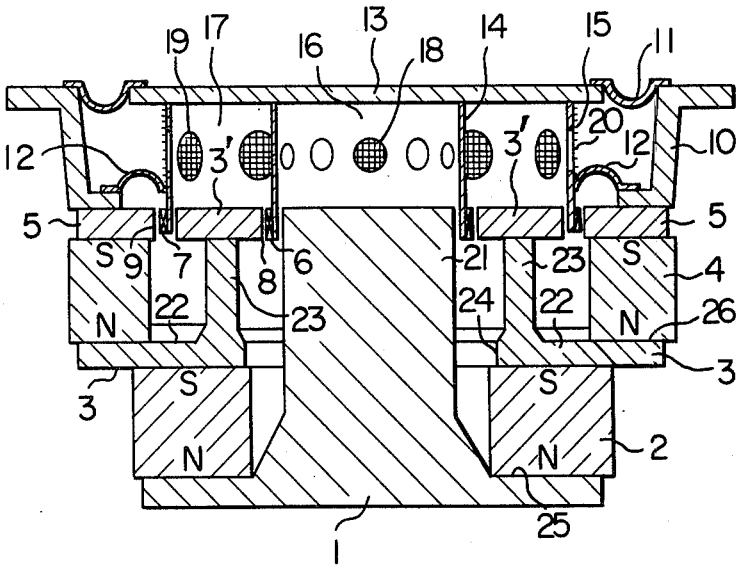
19
17
16
13
18
14
15
11
12
3'
3'
20
12
10
5
5
S
9
7
6
8
21
23
S
4
N
22
23
24
22
N
26
3
3
S
S
N
N
2
25
1

DYNAMIC SPEAKER

BACKGROUND OF THE INVENTION

1. Field of the Invention

The present invention relates to a dynamic speaker in which a single diaphragm is driven by double or multiple annular voice coils.

2. Description of the Prior Art

A loud speaker for converting an electrical signal of audio frequency band into an audio signal is required to exhibit a flat output sound pressure characteristic over a wide frequency band. Conventional loud speakers comprise a diaphragm mainly made of paper or a metal such as aluminum formed into a conical shape. Such a diaphragm has a conically concaved sound reflection surface, which causes ups and downs of the output sound pressure characteristic, thus making it impossible to produce a flat output sound pressure characteristic. In order to attain a construction of a flat sound reflection surface, a loud speaker made of a circular flat diaphragm has been suggested.

Such a loud speaker uses a diaphragm made of a foamed synthetic resin disc of a honey-comb metal disc covered with an aluminum foil on both sides thereof. This speaker has a flat front side and free of extraneous ups and downs, so that a flat output sound pressure characteristic is attained. Also, when this loud speaker is mounted on a baffle board, it is possible to arrange the front of the diaphragm in the same plane as the front of the baffle board, thus making it possible to make most of the effect of the baffle board.

When this flat diaphragm is reciprocated for free vibrations, however, the diaphragm is subjected to a split vibration at high frequency range, thus undesirably adversely affecting the output sound pressure characteristic. Specifically, when the diaphragm is vibrated at resonant frequency, the diaphragm is subjected to a split vibration in resonance with the particular frequency, so that some part of the diaphragm vibrates vertically while the other part thereof remains unvibrated. This split vibration occurs also at the secondary, tertiary, fourth-power, . . . N-th power frequency of the resonant frequency, with the result that many ups and downs occur in the high frequency range of the output sound pressure characteristic on the one hand and the primary split vibration occurs in a frequency range lower than the conical diaphragm on the other hand.

This split vibration of the flat diaphragm may be prevented by driving the nonvibrating part of the diaphragm, i.e., the nodes thereof, by means of a voice coil. When a circular diaphragm is subjected to a split vibration, the node where the amplitude of the diaphragm is zero takes a circular form. If this nodal circle is driven by a voice coil having the same diameter as the nodal circle, therefore, the split vibration can be prevented. By driving the tertiary mode of the nodal circle, for instance, the primary and secondary as well as the tertiary split virations may be prevented. In this case, however, since three nodal circles are driven, three voice coils are required. In view of the abovementioned fact that the split vibration of specific modes may be prevented by driving a nodal circle, it is desirable to drive a nodal circle of as high mode of power as possible.

In this way, a loud speaker in which a multiplicity of nodal circles are driven requires as many voice coils as the nodal circles driven, thus complicating the magnetic circuit for driving the voice coils. A magnetic circuit for driving such a loud speaker is disclosed, for example, in the Japanese Utility Model Laid-Open No. 52235/76 and Japanese Utility Model Laid-Open No. 52243/76 Specifications. This speaker comprises a plurality of magnets arranged perpendicular to the direction of vibration of the voice coils and also perpendicular to the length of the voice coil conductors. Another example of a loud speaker of this type, is disclosed by Japanese Utility Model Laid-Open No. 163120/78 and Japanese Utility Model Laid-Open No. 163121/78 Specifications, in which by use of a single magnet, magnetic fluxes produced thereform are passed sequentially through a plurality of gaps.

In the speaker of the first example, however, the magnetic poles may be supplied with magnetic energy only from a magnet of a size containable in a space corresponding to the gap between adjacent voice coils, so that the magnitude of the magnetic energy is limited by the space. Also the magnets are required to be magnetized in the direction perpendicular both to the direction of vibration of the voice coils and to the length of the voice coil conductor at the same time more inconveniently than when the magnets are magnetized along the direction of vibration of the voice coils.

In the case the second example in which a single magnet is used, on the other hand, the area and length of the magnet can be selected freely but, the total number of magnetic fluxes passing the gaps is made uniform, if the leakage magnetic fluxes are ignored. Therefore, it is impossible to distribute magnetic fluxes to each gap in a manner suitable for reducing the split vibration or eliminating a specific mode of vibrations.

SUMMARY OF THE INVENTION

Accordingly, it is an object of the present invention to provide a dynamic speaker in which the area and length of the magnet can be selected freely, on the one hand, and the magnetic fluxes may be distributed to the magnetic gaps freely, on the other hand.

Another object of the present invention is to provide a magnetic circuit in which magnets are held between adjacent magnetic poles of three or more layers, the magnets and magnetic poles are layered in the direction of vibration of the voice coils, a magnetic gap is formed along the above-mentioned direction between adjacent magnetic poles by a magnetic pole or another magnetic pole connected therewith, and when the magnets are magnetized in the above-mentioned direction, magnetic fluxes are passed through the magnetic gaps in the same direction as viewed from the center axis of the magnetic circuit.

BRIEF DESCRIPTION OF THE DRAWING

The drawing is a sectional view showing an embodiment of a dynamic speaker according to the present invention.

DESCRIPTION OF THE PREFERRED EMBODIMENTS

In the drawing, reference numeral 1 designates a first magnetic pole made of a magnetic material in disc form. At the center of this magnetic pole, there is provided a cylindrical pole piece 21 of a magnetic material and integral with the first magnetic pole 1. Numeral 2 designates a first magnet that is formed in an annular shape and is arranged on the upper side of the first magnetic pole 1. This annular magnet 2 is secured to the magnetic pole 1 by a bonding agent or the like. Numeral 3 designates a second magnetic pole arranged on the first magnet 2, which magnetic pole, having an L-shaped section, includes a flat portion 22 and a vertical portion 23. The second magnetic pole 3 is made of a magnetic material, the flat portion 22 and the vertical portion 23 are integrated with each other, and a gap 24 is provided where the pole piece 21 is to be inserted at the central part thereof. The magnetic pole 3 is also secured to the first magnet 2 with a bonding agent or the like. Numeral 4 designates a second magnet which is made in annular form and is secured to the upper side of the second magnetic pole 3 with a bonding agent or the like. Numeral 5 designates a third magnetic pole which is arranged on the upper side of the second magnet 4. This annular magnetic pole 5 is made of a magnetic material and is also secured to the second magnet 4 with a bonding agent or the like. Numeral 3' designates a fourth magnetic pole, made of an annular magnetic material, which is secured to the upper side of the vertical portion 23 of the second magnetic pole 3 with a bonding agent or the like. The height of the vertical portion 23 of the second magnetic pole is determined in such a manner that the third magnetic pole 5 is in the same plane as the fourth magnetic pole 3', while the height of the pole piece 21 is determined in such a manner that the inner surface of the fourth magnetic pole 3' is opposite to the outer surface of the upper side of the pole piece 21. A first air gap 8 is formed between the outer surface of the pole piece 21 and the inner surface of the fourth magnetic pole 3', and a second air gap 9 is formed between the outer surface of the fourth magnetic pole 3' and the inner surface of the third magnetic pole 5. An annularly wound first voice coil 6 is inserted into the first air gap 8, while a second voice coil 7, which is also wound annularly, is inserted into the second air gap 9.

The magnetic circuit thus comprises three magnetic poles 1, 3 and 5 and two magnets 2 and 4, laid one on another in the direction of vibration of the double annular voice coils 6 and 7 and bonded to each other by a bonding agent or the like, the magnetic pole 3' coupled to the magnetic pole 3 between the magnetic poles 1 and 5, and the magnetic air gaps 8 and 9 formed between the magnetic poles 1 and 3' and between the magnetic poles 3' and 5 respectively. The magnets 2 and 4 are magnetized in the same direction as the vibration of the voice coils 6 and 7, for instance, in such a direction that the magnetic fluxes pass toward the magnetic pole 1 through the magnetic pole 3' from the magnetic pole 5. In the case of the use of an external type magnetic circuit i.e., a magnetic circuit wherein the magnet is arranged externally about the center pole, as in this embodiment, every magnet is constructed to suit the external magnetic circuit type, while if the internal type magnetic circuit is utilized, i.e., one wherein the magnet is situated internally of the magnetic pole, every magnet is constructed as such an internal type. In this regard, it is noted that the equivalent use of internal and external type magnetic circuits in diaphragm speakers is known and, thus, those skilled in the art will recognize the manner in which the illustrated external magnetic circuit type embodiment can be modified into an embodiment utilizing an equivalent internal type magnetic circuit.

Because of the above manner of construction, the rear parts 25 and 26 of the respective poles 1,3 and the outer periphery of the two magnets 2 and 4 willl be situated in an open space, i.e., are not confined by any other adjoining parts, thus making it possible to select a magnet of the area and length required for design. The density of magnetic fluxes applied to the air gaps 8 and 9 is determined by the area and length (height) of the magnets 2 and 4 in contact with the first magnetic pole 1 and the second magnetic pole 3. Therefore, if the rear parts 25 and 26 and the magnets 2 are located in an open space at 4 and the outer periphery thereof, the area and length of the magnets 2 and 4 may be selected properly as desired. Also, since the area and length of the magnets 2 and 4 can be selected independently of each other, the magnetic fluxes and magnetic energy distributed respectively into the magnetic air gaps 8 and 9 also may be freely selected.

This loud speaker has two voice coils 6 and 7 for driving the nodal circle of the secondary mode of the flat circular diaphragm 13. The first voice coil 6 is wound on the outer periphery of the first voice coil bobbin 16, while the second voice coil 7 is wound on the outer periphery of the second voice coil bobbin 17. The upper end of the first voice coil bobbin 16 is connected to a position 0.39R of the diaphragm 13 while the upper end of the second voice coil bobbin 17 is connected to a position 0.84R of the diaphragm 13, where R is the radius of the diaphragm 13. The part of the diaphragm 13 where the upper ends of the two voice coil bobbins 16 and 17 are connected is the part where a nodal circle of secondary mode occurs at the time of split vibration of the diaphragm 13 and can be determined by well-known vibration mode, vibration frequency calculation formulas. By driving this nodal circle, the primary and secondary split vibrations of the diaphragms 13 are prevented. Further, when driving the nodal circle of secondary mode, the split vibration is prevented by driving the inner and outer nodal circles with driving forces of different magnitudes. Specifically, the ratio of the driving force generated in the first voice coil 6 and the second voice coil 7 may be set at 1 to 1.7 thereby to prevent the split vibration. This difference of driving force may be achieved by changing the density of magnetic fluxes in the first air gap 8 and the second air gap 9. This is easily achieved by changing the area and length of the first and second magnets, namely, the sizes of the first and second magnets independently of each other.

The number of magnetic fluxes passing the vertical portion 23 of the second magnetic pole 3 is smaller than the number of magnetic fluxes passing the first magnetic pole or the third magnetic pole 5, i.e., vertical portion 23 is in the magnetic circuit of both magnet 2 and magnet 4, while the first and third poles are not. Furthermore, the magnetic flux paths of magnets 2 and 4 are such that the magnetic flux of magnet 2 in portion 23 is opposite that of magnet 4 in portion 23, so that they act so as to produce a reduced net flux relative to the magnetic flux passing through either of poles 1, 5. Therefore, the sectional area of the magnetic path of the vertical portion 23 can be made smaller than that of the latter so that the magnetic circuit is made compact and light in weight, on the one hand, yet magnetic saturation rarely occurs, even in the case where the distance between the adjacent voice coils 6 and 7 is narrow, on the other hand.

Further, the loud speaker according to the present invention may be magnetized easily in the same manner as conventional ordinary speakers.

The magnetic circuit is coupled with a frame 10 with a screw (not shown) so that the circular diaphragm 13 and the bobbin 15 bonded thereto are suspended on the frame 10 by means of an edge suspension 11 and a centering spider 12. The voice coils 6 and 7 are wound and bonded on the lower end of the bobbins 14 and 15 respectively, so that the voice coils 6 and 7 may vibrate in the magnetic air gaps 8 and 9 respectively.

The voice coils 6 and 7 are electrically connected in series or parallel to each other so that they may vibrate in the same direction at the same time. Alternatively, the voice coils 6 and 7 may of course be driven independently of each other to vibrate in the same direction at the same time without being connected to each other.

In order to reduce the pressure change in the air gaps 16 and 17, air holes 18 and 19 should be formed in the bobbins 14 and 15 respectively. The air hole 19 is desirably covered with a dust-proof cloth 20.

Although the embodiment under consideration comprises two voice coils, the number and diameter of the bobbins and voice coils may be selected as desired freely according to the object involved. In order to dampen the n-th power of split vibration of the diaphragm, for instance, all the nodes up to the n-th power mode are driven by the voice coils of the same diameter and in the same number as the nodes.

The embodiment under consideration concerns a magnetic circuit 21 of external magnetic type. In the case of an external type of magnetic circuit, the outermost magnetic path is shortest so that, since magnetic resistance increases with the length of the magnetic flux path, the leakage of the magnetic fluxes is smallest at the outermost magnetic path. Thus the external magnetic type of magnetic circuit is suitable for the case in which the magnetic energy at the outermost magnetic gap is maximized.

The present invention may also be constructed of a magnetic circuit of internal magnetic type. Contrary to the external magnetic type, the innermost magnetic path is shortest in the case of the magnetic circuit of internal magnetic type, thus making it possible to reduce the leakage of magnetic fluxes at the innermost magnetic path more than at the other paths. The internal magnetic type of magnetic circuit, therefore, it suitable for the case in which the energy in the innermost gap is desired to be maximized.

Furthermore, the present invention is not limited to the case where nodes alone are driven, but a multiplicity of voice coils may be provided at equal distance to each other to drive the diaphragm.

What is more, the present invention may be applied to the cone diaphragm or dome diaphragm with equal effect.

In addition, the loud speaker according to the invention may be formed of a single diaphragm or two or more diaphragms of the same shape or different shapes coupled to each other.

I claim:

1. A dynamic speaker comprising:

first, second and third magnetic poles arranged in at least three layers in spaced relation with each other;

a first magnet arranged between said first and second magnetic poles;

a second magnet arranged between said second and third magnetic poles;

a fourth magnetic pole interposed between the magnetic path of said first magnetic pole and the magnetic path of said third magnetic pole for forming first and second air gaps within said respective magnetic paths;

a first voice coil inserted into said first air gap;

a second voice coil inserted into said second air gap; and a diaphragm coupled to said first and second voice coils and driven by said first and second voice coils.

2. A dynamic speaker according to claim 1, wherein said first and second magnets are magnetized in the same direction, said direction being the same as the direction of vibration of said first and second voice coils.

3. A dynamic speaker according to claim 1, wherein said first and second voice coils are arranged so as to drive nodes of split vibration of said diaphragm.

4. A dynamic speaker according to claim 3, wherein said diaphragm is flat and circular in shape, and said first and second voice coils drive nodal circles of split vibration of said diaphragm.

* * * * *